US005511754A

United States Patent [19]

Johannsen

[11] Patent Number: 5,511,754

[45] Date of Patent: Apr. 30, 1996

[54] CUP HOLDING DEVICE

[76] Inventor: Christian J. Johannsen, 2665 S. Bayshore Dr., #1200, Coconut Grove, Fla. 33133

[21] Appl. No.: 320,371

[22] Filed: Oct. 11, 1994

Related U.S. Application Data

[63] Continuation of Ser. No. 149,673, Nov. 9, 1993, abandoned.

[51] Int. Cl.[6] ..... A47K 1/08

[52] U.S. Cl. ..... 248/311.2; 248/315

[58] Field of Search ..... 248/311.2, 315, 248/497, 489, 104, 317, 318, 690, 691, 692, 693, 322; 211/119

[56] References Cited

U.S. PATENT DOCUMENTS

| | | | |
|---|---|---|---|
| 387,082 | 7/1888 | Lemberger | 248/311.2 |
| 1,086,541 | 2/1914 | Lailer | 248/311.2 |
| 1,163,044 | 12/1915 | Stocum | 248/311.2 |
| 1,459,192 | 6/1923 | Bell | 248/311.2 |
| 1,510,294 | 9/1924 | Bertrand | 248/218.1 |
| 1,511,954 | 10/1924 | Elliott | 248/311.2 |
| 1,530,256 | 3/1925 | Garland | 248/315 |
| 1,600,931 | 9/1926 | Chatham | 248/318 |
| 2,359,452 | 10/1944 | Summers, Sr. | 248/104 |
| 2,545,414 | 3/1951 | Smith | 248/104 |
| 2,632,320 | 3/1953 | Liss | 248/311.2 |
| 2,646,243 | 7/1953 | Rycroft | 248/315 |
| 2,809,760 | 10/1957 | Clark | 248/311.2 X |
| 2,995,333 | 8/1961 | Pazzano | 248/311.2 X |
| 3,228,577 | 1/1966 | Croft | 248/317 |
| 3,306,566 | 2/1967 | Paulson et al. | 248/315 X |
| 3,480,244 | 11/1969 | Iversen | 248/315 |
| 3,867,788 | 2/1975 | Mickelson | 248/318 X |
| 4,032,102 | 6/1977 | Wolf et al. | 248/318 |
| 4,669,693 | 6/1987 | Kagon | 248/318 |
| 4,955,807 | 9/1990 | Chance et al. | 248/523 X |

*Primary Examiner*—Alvin C. Chin-Shue
*Assistant Examiner*—Korie H. Chan
*Attorney, Agent, or Firm*—Burgess, Ryan and Wayne

[57] ABSTRACT

A cup supporting device includes a ring having an opening through which a cup can be inserted; two straps secured to the ring in diametrical relation to each other; a hook member secured to the free end of each strap for hanging the cup supporting device from a chair back; a helical coil spring having an upper end secured to the underside of the ring and hanging downwardly from the ring, the helical coil spring being positioned so as to be in axial alignment with the ring so as to restrain sideward movement of the cup and to hold the cup placed therein through the opening in the ring; and a stop bar secured in diametrical relation across the lower end of the helical coil spring for supporting the cup within the helical coil spring.

7 Claims, 4 Drawing Sheets

CUP HOLDING DEVICE

This application is a continuation, of application Ser. No. 149,673, filed Nov. 9, 1993 now abandoned.

BACKGROUND OF THE INVENTION

The present application relates generally to cup holding devices and, more particularly, is directed to a cup holding device which can be hung from a seat back in a stadium or the like.

In most athletic stadiums, two adjacent seats share the same armrest and such armrests are not sufficiently wide to support a cup. The problem, therefore, results as to where to place a drink at an athletic event. If the cup is placed on the floor in front of the stadium seat, there is a tendency for the cup to spill, particularly if the spectator excitedly jumps up or if other spectators walk pass.

Another related problem is that stadium seats not only come in different sizes, but also have different shapes, thicknesses and angles, thereby making it difficult to support any device therefrom.

OBJECTS AND SUMMARY OF THE INVENTION

Accordingly, it is an object of the present invention to provide a cup supporting device that avoids the aforementioned difficulties encountered with the prior art.

It is another object of the present invention to provide a cup supporting device that can be hung from substantially any stadium seat.

It is still another object of the present invention to provide a cup supporting device that is readily accessible to a spectator.

It is another object of the present invention to provide a cup supporting device that is compressed to a small size during storage and which expands during usage.

It is a further object of the present invention to provide a cup supporting device that is easy and economical to use and manufacture.

In accordance with an aspect of the present invention, a cup supporting device includes a main body member having an opening through which a cup can be inserted; supporting means for supporting the main body member from a frame; helical coil spring means for holding the cup therein and for restraining sideward movement of the cup, the helical coil means having first and second opposite ends, the first end secured to the main body member and the helical coil spring means extending downwardly from the main body member, the helical coils spring means surrounding an area in alignment with the opening in the main body member, and stop means for supporting the cup, the stop means being secured to the second end of the helical coil spring means.

The above and other objects features and advantages of the present invention will become readily apparent from the following detailed description thereof which is to be read in connection with the accompanying drawings.

DETAILED DESCRIPTION OF A PREFERRED EMBODIMENT

Figure 4:
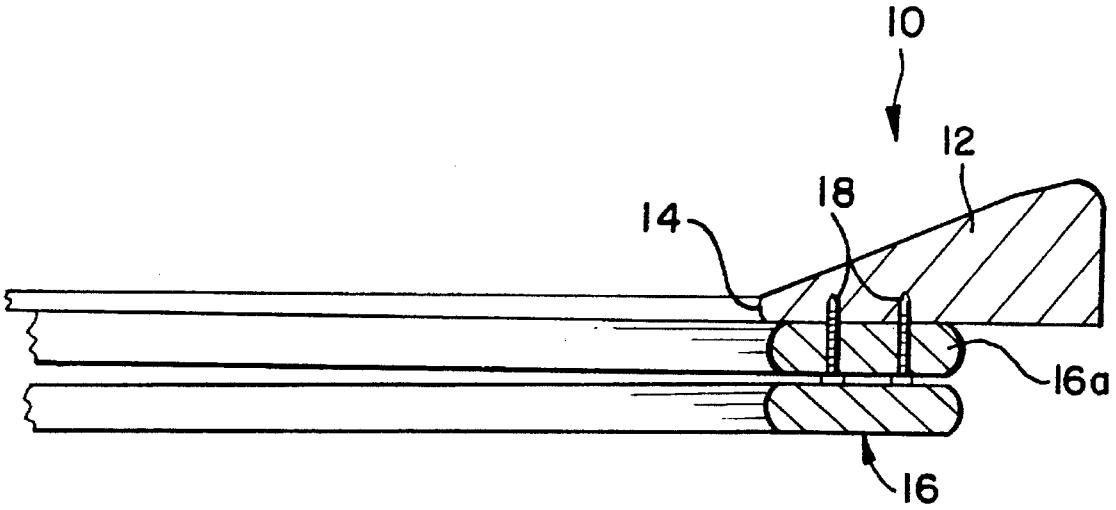
FIG. 4 is a cross-sectional view of a portion of the cup supporting device of FIG. 1 showing attachment of the helical coil spring to the main body member.

Referring to the drawings in detail, a cup supporting device, according to the present invention, includes a main body member 12 in the form of a rigid plastic ring. Ring 12 has a substantially triangular cross-sectional configuration, as shown best in FIG. 4 such that the thickness of ring 12 decreases from the outer periphery to the inner periphery thereof. Ring 12 defines a central circular opening 14 through which a cup can be inserted.

A helical coil spring 16 of a substantially identical diameter as ring 12 is positioned in axial alignment with ring 12. Helical coil spring 16 has a first end **16*a* secured to the underside of ring 12 by any suitable means such as screws or bolts 18. Accordingly, when ring 12 is held in a horizontal position, coil spring 16 will uncoil somewhat and hang down from ring 12. It will be appreciated that helical coil spring 16 surrounds an area in alignment with opening 14 of ring 12 so that a cup can be inserted through opening 14 and within the area surrounded by helical coil spring 16. In this manner, helical coil spring 16** holds the cup therein and restrains sideward movement of the cup.

Figure 1:
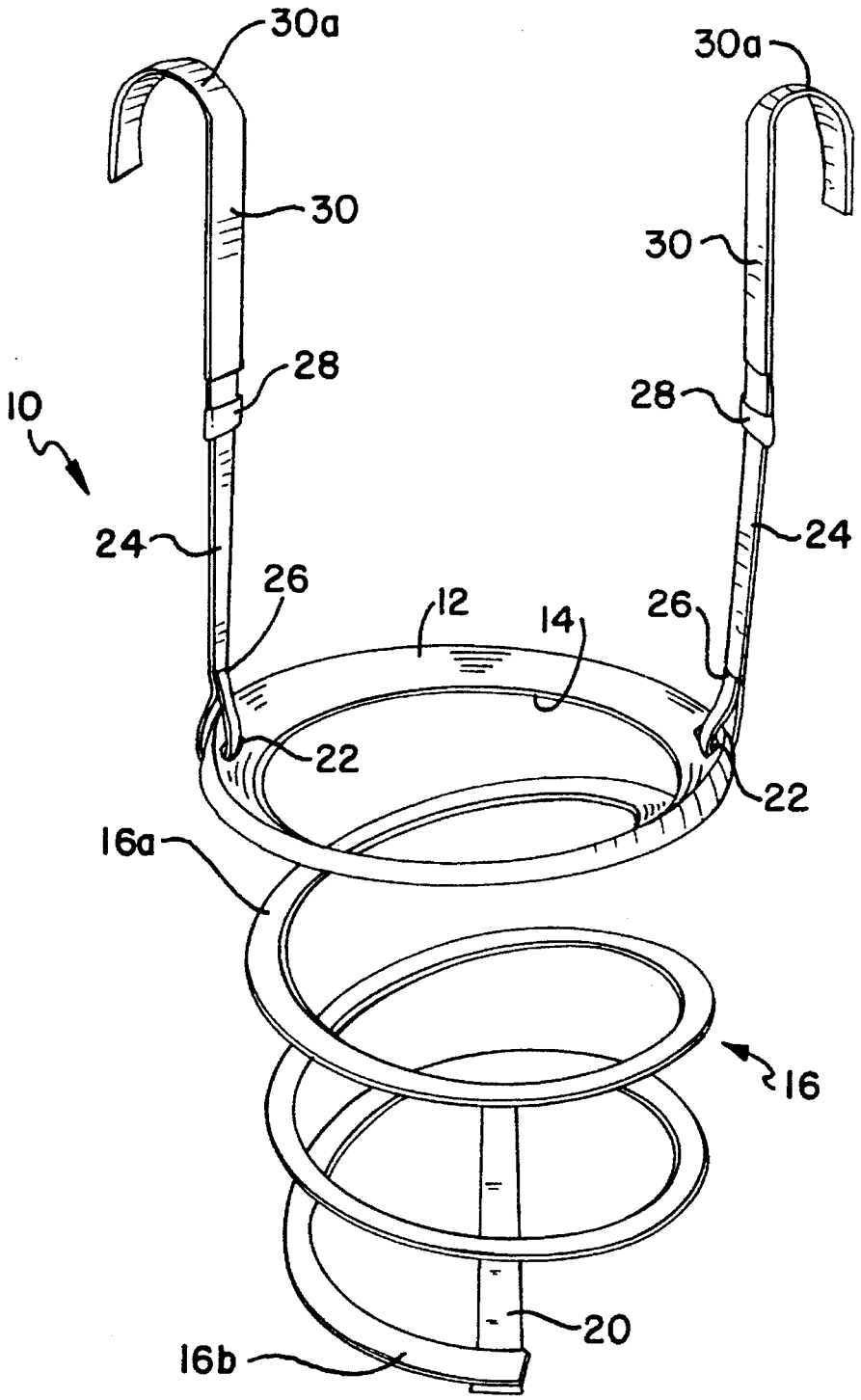
FIG. 1 is a perspective view of the cup supporting device according to the present invention shown in an expanded view for supporting a cup.
Figure 2:
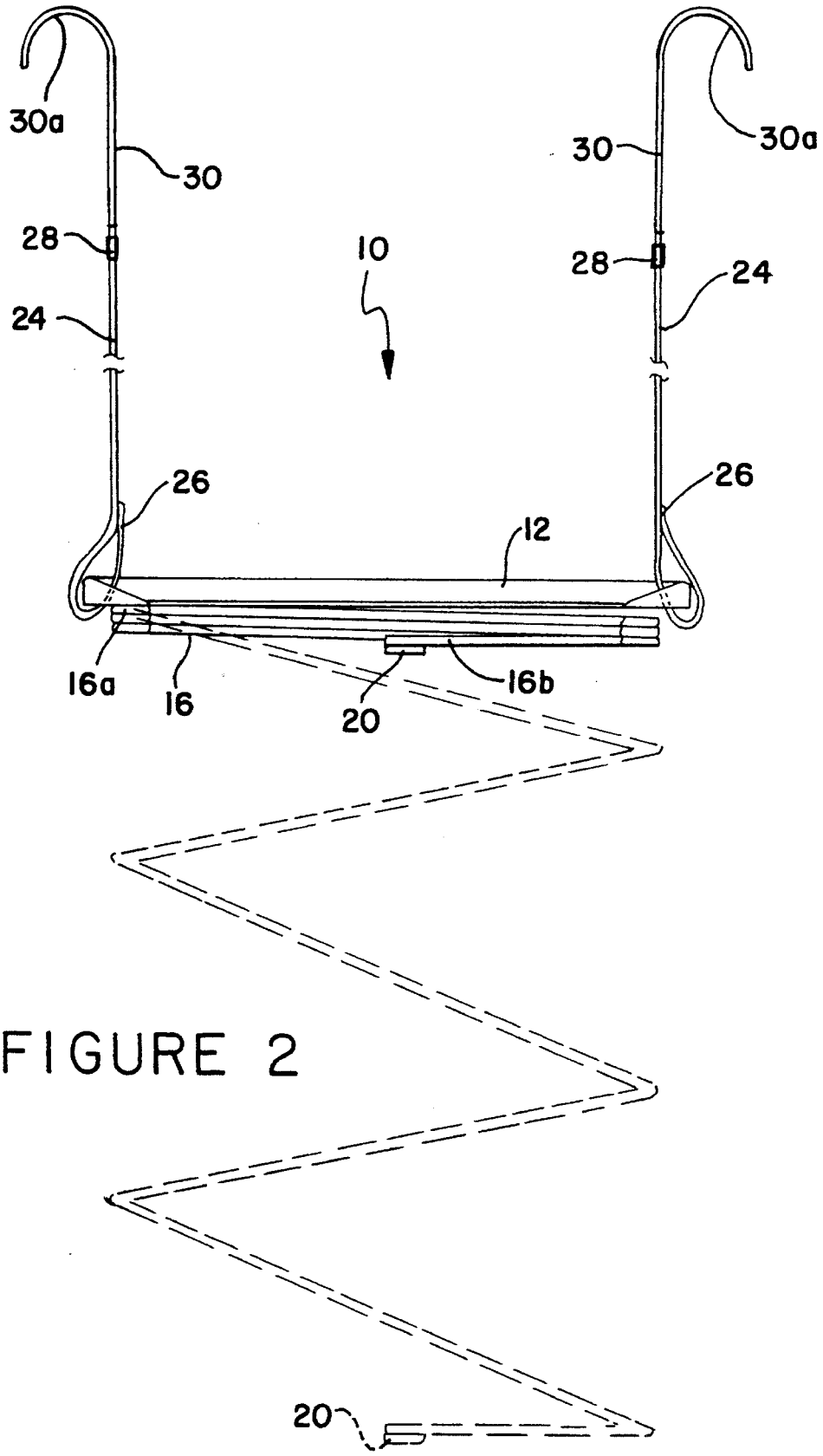
FIG. 2 is a side elevational view of the cup supporting device of FIG. 1, with the coil spring being shown in dashed lines in its expanded configuration.
Figure 3:
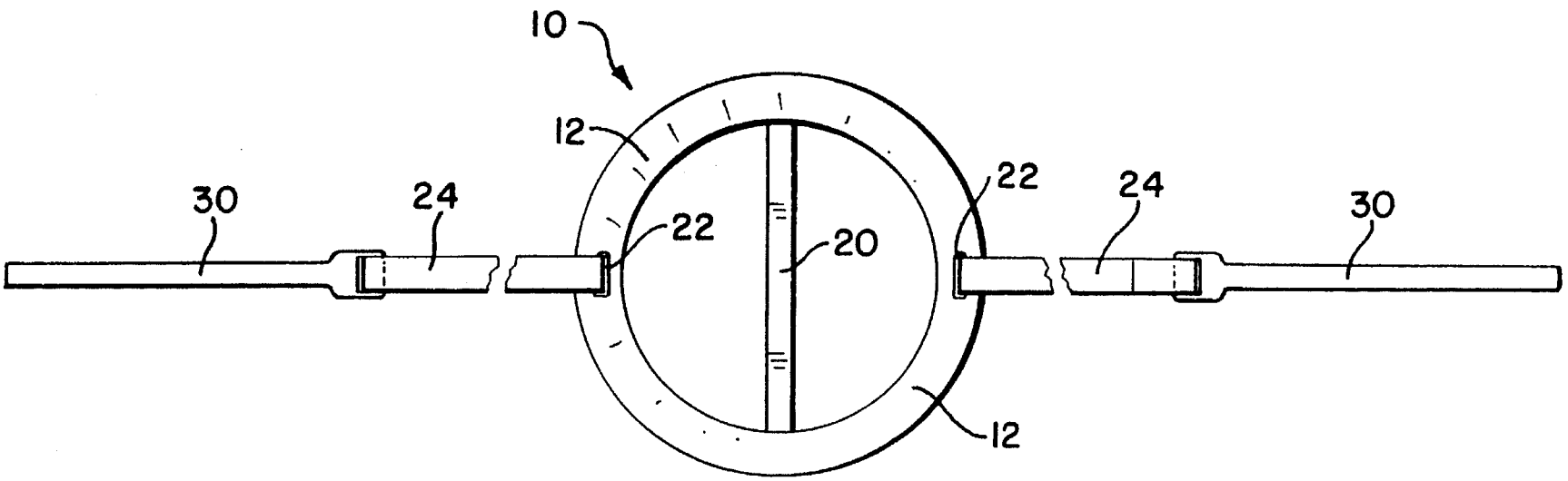
FIG. 3 is a top plane view of the cup supporting device of FIG. 1.

In order to support the cup in such position, a stop bar 20 is secured diametrically across the lower end **16*b* of helical coil spring 16, as shown best in FIGS. 1 and 3. As a result, when ring 12 is supported in a horizontal position, as will be explained in detail below, a cup that is inserted through opening 14 rests on stop bar 20 and is supported thereby. In such case, helical coil spring 16 uncoils by a greater amount, depending upon the weight of the cup. Of course, additional stop bars 20 can be provided. Further, the extent of uncoiling helical coil spring 16 will depend upon the material of spring 16**, the rigidity thereof, the thickness thereof and the like.

In order to support cup supporting device 10 from a frame, such as a chair back, diametrically opposite slits 22 are provided in ring 12 and extend entirely through ring 12. An elastic strap 24 is inserted through each slot 22 and has one end thereof secured to itself at 26 by any suitable means, such as stitching, adhesive or the like. The opposite end of each elastic strap 24 is secured by a band 28 or the like to the lower end of a hook member 30. In this regard, the curved ends **30*a* of hook members 30 can be placed over the upper edge of a chair back, where upon ring 12 will be supported in a hanging manner by means of elastic straps 24. As a result, helical coil spring 16 will hang downwardly from ring 12**.

In usage, a cup is inserted through opening 14 of ring 12 and supported within helical spring 16 by stop bar 20. The weight of the cup will uncoil helical spring 16 to a greater extent. Preferably, the amount of uncoiling of helical spring 16 is such that the cup can be easily grasped and removed by a person.

It will, therefore, be appreciated that cup supporting device 10 can be used with any stadium seat or the like by two simple hooks which attach on the chair back. When cup supporting device 10 is not in use, helical coil spring 16 will compress so that cup supporting device 10 becomes small and compact and can fit in a shirt pocket, pants pocket, purse or the like.

Further, although cup supporting device 10 has been described as being used in a stadium seat, it can be supported from any other suitable structure, such as any chair back, a car seat back or any other suitable frame member.

Having described a specific preferred embodiment of the invention with reference to the accompanying drawings, it will be appreciated that the present invention is not limited to that precise embodiment, and that various changes and modifications can be effected therein by one of ordinary skill in the art without departing from the spirit or scope of the invention as defined by the appended claims.

What is claimed is:

1. A cup supporting device for securement onto a frame, comprising:

a main body member having an opening through which a cup can be inserted;

supporting means for supporting said main body member from the frame, said supporting means including:

at least one strap, said at least one strap having a first end connected with said main body member and a second end, and hook means for hooking onto the frame, said hook means being connected to the second end of said at least one strap;

a helical coil spring for holding said cup therein and for restraining sideward movement of said cup, said helical coil spring having first and second opposite ends and a middle section connecting said first and second ends, with only said first end being secured to said main body member and said middle section and said second end hanging freely such that said helical coil spring extends downwardly from said main body member, said helical coil spring surrounding an area in alignment with said opening in said main body member, said helical coil spring compressing such that coils thereof are in contact with each other when said helical coil spring is placed on a surface and said main body member is unsupported by said supporting means, and said helical coil spring expanding such that coils thereof separate from each other by a distance depending upon the weight of said cup held thereby when said main body member is supported by said supporting means; and stop means for supporting said cup, said stop means being secured to said second end of said helical coil spring.

2. A cup supporting device according to claim 1, wherein such strap means is made from an elastic material.

3. A cup supporting device according to claim 1, wherein said main body member includes at least one opening and said at least one strap is secured to said body member through said at least one opening.

4. A cup supporting device according to claim 1, wherein said stop means includes a stop bar secured in diametrical relation across said second end of said helical coil spring means.

5. A cup supporting device according to claim 1, wherein there are two of said straps in diametrically opposite relation to each other with respect to said main body member.

6. A cup supporting device according to claim 1, wherein said main body member is in the form of a ring.

7. A cup supporting device for securement onto a frame, comprising:

a ring member defining a central opening therewithin through which a cup can be inserted and having peripheral openings in said ring member;

supporting means for supporting said ring member from the frame, said supporting means including:

two elastic straps having a first end connected in said peripheral openings in said ring member in diametrically opposite relation to each other, and a second end, and hook means for hooking on to the frame, said hook means being connected to the second end of each said strap;

helical coil spring means for holding said cup therein and for restraining sideward movement of said cup, said helical coil spring means having first and second opposite ends, said first end secured to said ring member and said helical coil spring means extending downwardly from said ring member, said helical coil spring means surrounding an area in alignment with said central opening in said ring member, said helical coil spring means compressing such that coils thereof are in contact with each other when said helical coil spring means is placed on a surface and said ring member is unsupported by said supporting means, and said helical coil spring means expanding such that coils thereof separate from each other by a distance depending upon the weight of said cup held thereby when said ring member is supported by said supporting means; and stop means for supporting said cup, said stop means being secured to said second end of said helical coil spring means, said stop means including a cross bar connected in diametrical relation across said second end of said helical coil spring means.

* * * * *